US008716639B2

(12) United States Patent
Mallon

(10) Patent No.: US 8,716,639 B2
(45) Date of Patent: May 6, 2014

(54) STEERABLE PROJECTILE

(75) Inventor: Paddy Mallon, Nr Weybridge (GB)

(73) Assignee: Thales Holdings UK PLC, Surrey (GB)

( * ) Notice: Subject to any disclaimer, the term of this patent is extended or adjusted under 35 U.S.C. 154(b) by 307 days.

(21) Appl. No.: 12/922,407

(22) PCT Filed: Mar. 11, 2009

(86) PCT No.: PCT/GB2009/000658

§ 371 (c)(1),
(2), (4) Date: Jan. 10, 2011

(87) PCT Pub. No.: WO2009/112829

PCT Pub. Date: Sep. 17, 2009

(65) Prior Publication Data

US 2011/0101154 A1 May 5, 2011

(30) Foreign Application Priority Data

Mar. 13, 2008 (GB) ..... 0804951.2

(51) Int. Cl.

| | |
|---|---|
| ***F42B 10/60*** | (2006.01) |
| ***F42B 15/10*** | (2006.01) |
| ***F41G 9/00*** | (2006.01) |
| *F42B 10/00* | (2006.01) |
| *F42B 15/00* | (2006.01) |

(52) U.S. Cl.
USPC ..... 244/3.11

(58) Field of Classification Search
USPC ..... 244/3.1–3.3, 117 R, 117 A; 102/374, 102/376, 382, 384, 398, 399, 501, 517, 518, 102/514, 516, 519
See application file for complete search history.

(56) References Cited

U.S. PATENT DOCUMENTS

| | | | | | |
|---|---|---|---|---|---|
| 603,466 | A | * | 5/1898 | Hammer | 102/399 |
| 671,877 | A | * | 4/1901 | Franklin | 244/3.23 |
| 1,178,516 | A | * | 4/1916 | Herschel | 102/501 |
| 2,612,108 | A | * | 9/1952 | Schmidt | 102/519 |
| 3,028,128 | A | * | 4/1962 | Friedrich | 244/117 A |
| 3,128,067 | A | * | 4/1964 | Loegering et al. | 244/117 A |
| 3,282,214 | A | * | 11/1966 | Briscoe | 102/376 |
| 3,357,357 | A | * | 12/1967 | Voss | 102/516 |
| 3,401,637 | A | * | 9/1968 | Briscoe | 102/501 |
| 3,949,677 | A | * | 4/1976 | Voss | 102/501 |

(Continued)

FOREIGN PATENT DOCUMENTS

| | | |
|---|---|---|
| DE | 41 42 116 | 6/1993 |
| DE | 10 2005 043474 | 3/2007 |
| FR | 2892808 | 5/2007 |
| GB | 2 423 502 | 8/2006 |

OTHER PUBLICATIONS

Search Report, mailed on Jul. 13, 2009, for PCT/GB2009/000658, filed on Mar. 11, 2009.

(Continued)

*Primary Examiner* — Bernarr Gregory
(74) *Attorney, Agent, or Firm* — Stroock & Stroock & Lavan LLP

(57) ABSTRACT

A steerable projectile (30) comprises a body portion (32) and a nose portion (34). The nose portion and body portion are substantially coaxially arranged and rotatable relative to one another about their co-axis. The nose portion further comprises an asymmetric formation (36) operable to enable the projectile to be subjected to off-axis drag during flight.

19 Claims, 4 Drawing Sheets

(56) References Cited

U.S. PATENT DOCUMENTS

| | | | | | |
|---|---|---|---|---|---|
| 4,123,975 | A | * | 11/1978 | Mohaupt | 102/518 |
| 4,389,028 | A | * | 6/1983 | Kalivretenos et al. | 244/3.21 |
| 4,637,313 | A | * | 1/1987 | Henderson et al. | 102/398 |
| 5,322,243 | A | | 6/1994 | Stoy | |
| 5,788,178 | A | | 8/1998 | Barrett, Jr. | |
| 6,012,393 | A | * | 1/2000 | Tal | 102/398 |
| 6,422,507 | B1 | | 7/2002 | Lipeles | |
| 7,431,237 | B1 | * | 10/2008 | Mock et al. | 244/3.24 |
| 8,466,397 | B1 | * | 6/2013 | Teter et al. | 244/3.21 |
| 2005/0056723 | A1 | | 3/2005 | Clancy et al. | |

OTHER PUBLICATIONS

Search Report dated Apr. 23, 2009, for GB0904189.8, filed on Mar. 11, 2009.

Search Report dated Jul. 23, 2008, for GB0804951.2, filed on Mar. 13, 2008.

* cited by examiner

STEERABLE PROJECTILE

CROSS-REFERENCE TO RELATED APPLICATIONS

This application is the National Stage of International Application No. PCT/GB2009/000658, filed on Mar. 11, 2009, which claims the benefit of British Application No. 0804951.2, filed Mar. 13, 2008. The contents of all of these applications are incorporated by reference herein.

BACKGROUND

The present invention relates to the steering of a projectile. It is particularly, but not exclusively, concerned with small projectiles such as would be fired from a gun, with the form of a bullet.

Although steerable projectiles are disclosed in, for instance, UK patent application GB2423502, such projectiles are unsuitable for adaptation into a bullet type formation. Active surfaces of the missile disclosed in that application are provided by canards which protrude substantially radially from the nose portion of the missile.

Further active surfaces are also provided at the tail portion of such a missile by means of tail fins which protrude radially from the missile. These radially protruding portions are incapable of being accommodated into a gun barrel without the very high likelihood of mechanical deformation or other damage. This will severely impact on the flight performance of the projectile.

It is desirable to provide a bullet which can be steered, to take advantage of developments in guidance of projectiles from a firing position. This can improve accuracy and, particularly in the context of military deployment, can enhance the effectiveness of the projectile as a weapon. In many circumstances, the element of surprise is very valuable to a user of such devices and inaccuracy (and therefore loss of surprise) is likely to lead to failure of the particular deployment circumstance.

BRIEF SUMMARY OF EMBODIMENTS OF THE INVENTION

Therefore, according to the invention, there is provided a steerable projectile comprising a body portion and a nose portion, the nose portion and body portion being substantially coaxially arranged, the nose portion further comprising an asymmetric formation to cause said projectile to be subjected to off-axis drag during flight.

In one embodiment of the invention, the body portion is substantially cylindrical and the nose portion is, but for the asymmetric formation, substantially rotationally symmetrical and coaxial with the body portion.

BRIEF DESCRIPTION OF THE DRAWINGS

Further aspects, features and advantages of the invention will become apparent from the following description of specific embodiments thereof, in conjunction with the accompanying drawings in which.

DETAILED DESCRIPTION OF THE PREFERRED EMBODIMENTS

Figure 1:
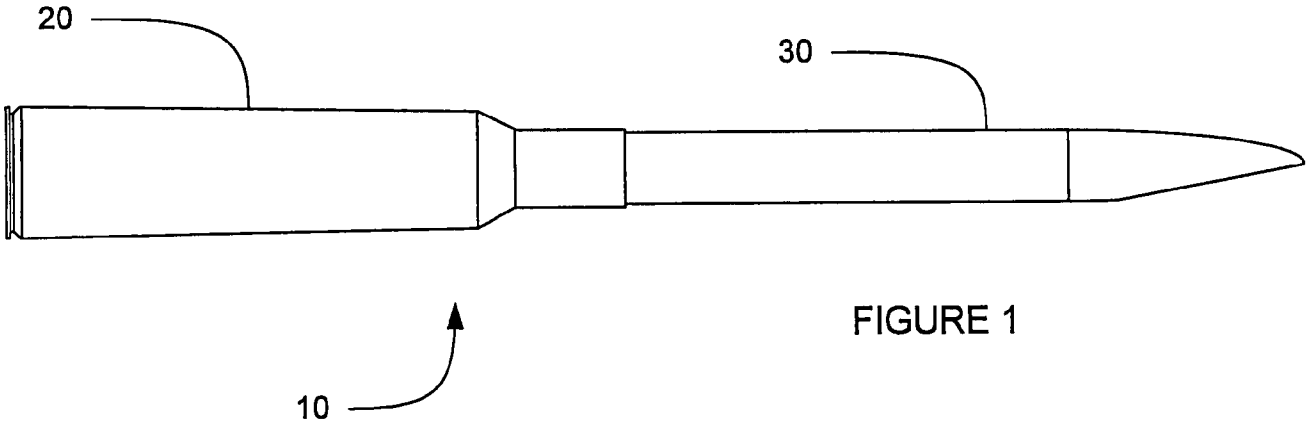
FIG. 1 is a side elevation of a bullet prior to ignition, illustrative of the field of the invention.
Figure 3:
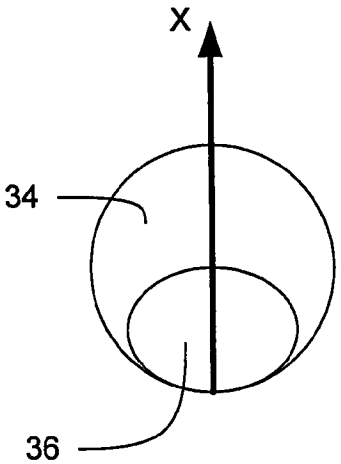
FIG. 3 is an elevation view of the nose of the bullet illustrated in FIGS. 1 and 2.
Figure 2:
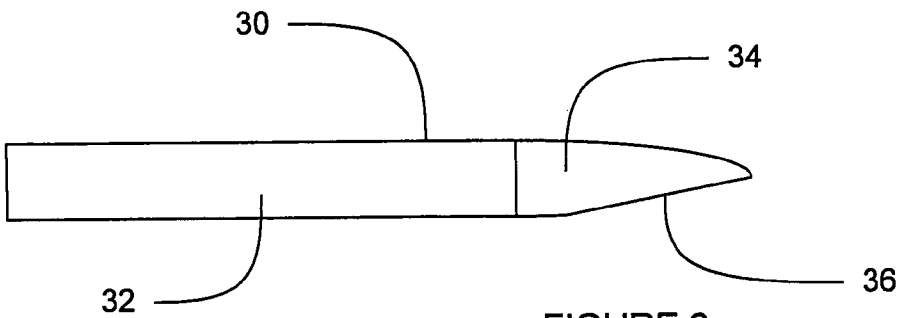
FIG. 2 is a side elevation of the bullet illustrated in FIG. 1 after ignition.

Referring firstly to FIG. 1, a bullet assembly 10 comprises a casing 20 of conventional construction into which is crimped a bullet 30. As further illustrated in FIG. 2, when the bullet is fired (by conventional percussive means), explosive material in the casing is ignited and causes the bullet 30 to become detached from the casing 20. The bullet is projected, for example along a rifled gun barrel, and expelled from the gun. The bullet 30 comprises a cylindrical body portion 32 and a nose portion 34. The shape of the nose portion 34 is of interest in the context of the invention. It is of generally ellipsoidal profile, with a flat formation extending off-axis from the tip of the nose. This flat formation 36 provides asymmetry to the nose portion, which leads to off-axis drag in the direction X indicated in FIG. 3.

The angle of the flat formation, relative to the axis of the bullet as a whole, is subject to considerable design selection and freedom. In essence, the angle of the flat surface relative to the overall longitudinal axis of the projectile should be chosen to impose a useful off-axis drag force, against constraints such as the likelihood of stalling, and the mechanical strength of the nose.

In use, the bullet will, on expulsion from a gun barrel, be rotating its elongate axis as a result of rifling of the gun barrel. It is possible that the speed of rotation will be in excess of 2000 Hz. The rotation will be imparted to the body, whereas it is intended that the nose will counter rotate relative to the body during flight. As required, by such counter rotation, the nose can be rendered substantially stationary with respect to the ground, so that the asymmetry provided by the flat formation 36 can impart a steering force on the bullet, to interact with a guidance system such as provided for on the gun.

It will be appreciated that the nose portion need not be rotationally stationary with respect to the ground at all times. Only when the bullet's trajectory needs to be modified, by application of the steering drag force from the asymmetry, does the rotation of the nose need to be under complete control. However, in many circumstances, it will be appropriate to control the orientation of the nose as much as possible, to avoid delays in achieving control when such control is required.

Figure 4:
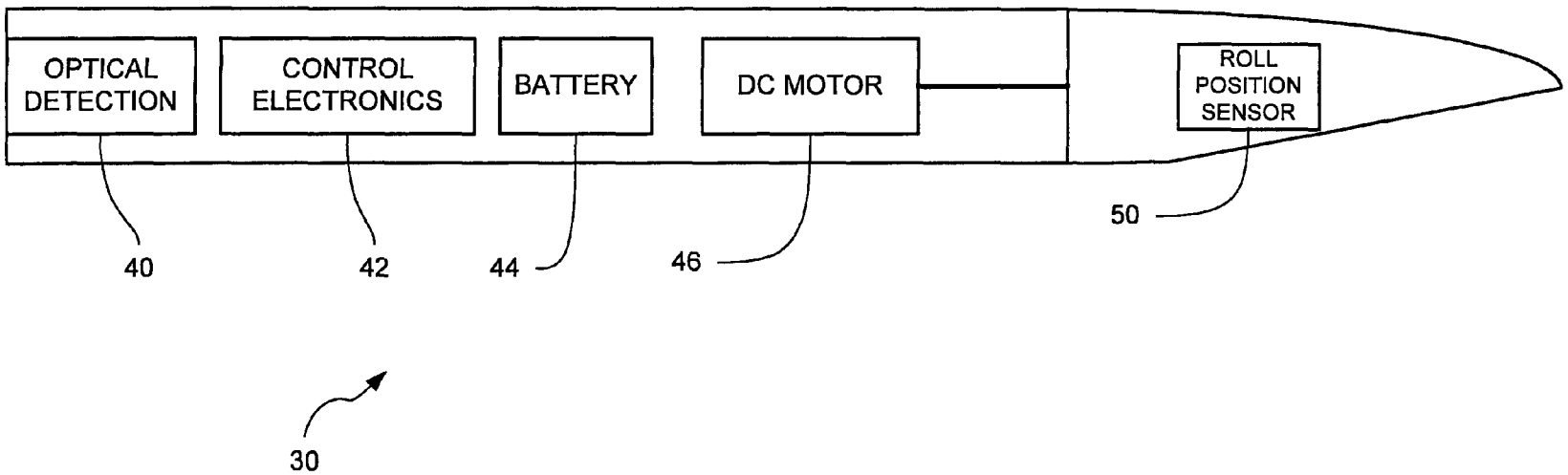
FIG. 4 is a schematic diagram illustrating the internal parts of the bullet illustrated in FIGS. 1 to 3.

This is achieved using capabilities provided in the interior of the bullet, as illustrated in FIG. 4.

An optical detection unit 40 comprises a photodiode of suitable wavelength in accordance with the guidance system used with the bullet, to detect laser guidance information received from the guidance system. It will be appreciated that in this example a laser guidance system is assumed to be provided, although other guidance systems could equally be appropriate. In the envisaged embodiment, the laser guidance system will use near infra red laser light, at intensities which are largely eye safe at practical distances (for example at approximately 10 metres). Thus, visibility by an observer, a target, or by electronic countermeasures will be severely limited.

Control electronics take account of guidance data information provided in the optical detection unit 40. The control electronics, together with optical detection unit 40 and other components of the bullet are powered by a battery 44. A DC motor 46 provides drive to the nose 32.

A roll position sensor 50 provides information to the control electronics 42 as to the angular position of the nose with regard to its flat formation 36. It will be appreciated that the nose and body portions of the bullet are substantially decoupled, and so wireless means will need to be provided in order to transmit information from the roll position sensor to the control electronics 42. Moreover, it will be understood by the reader that the implementation of the roll position sensor 50 which, in many circumstances (such as a missile), could be provided by a mechanical gyro, cannot so be provided in a bullet as accelerations would be too high, and so electronic means, such as an electronic accelerometer or a magnometer could be used in the alternative.

Figure 5:
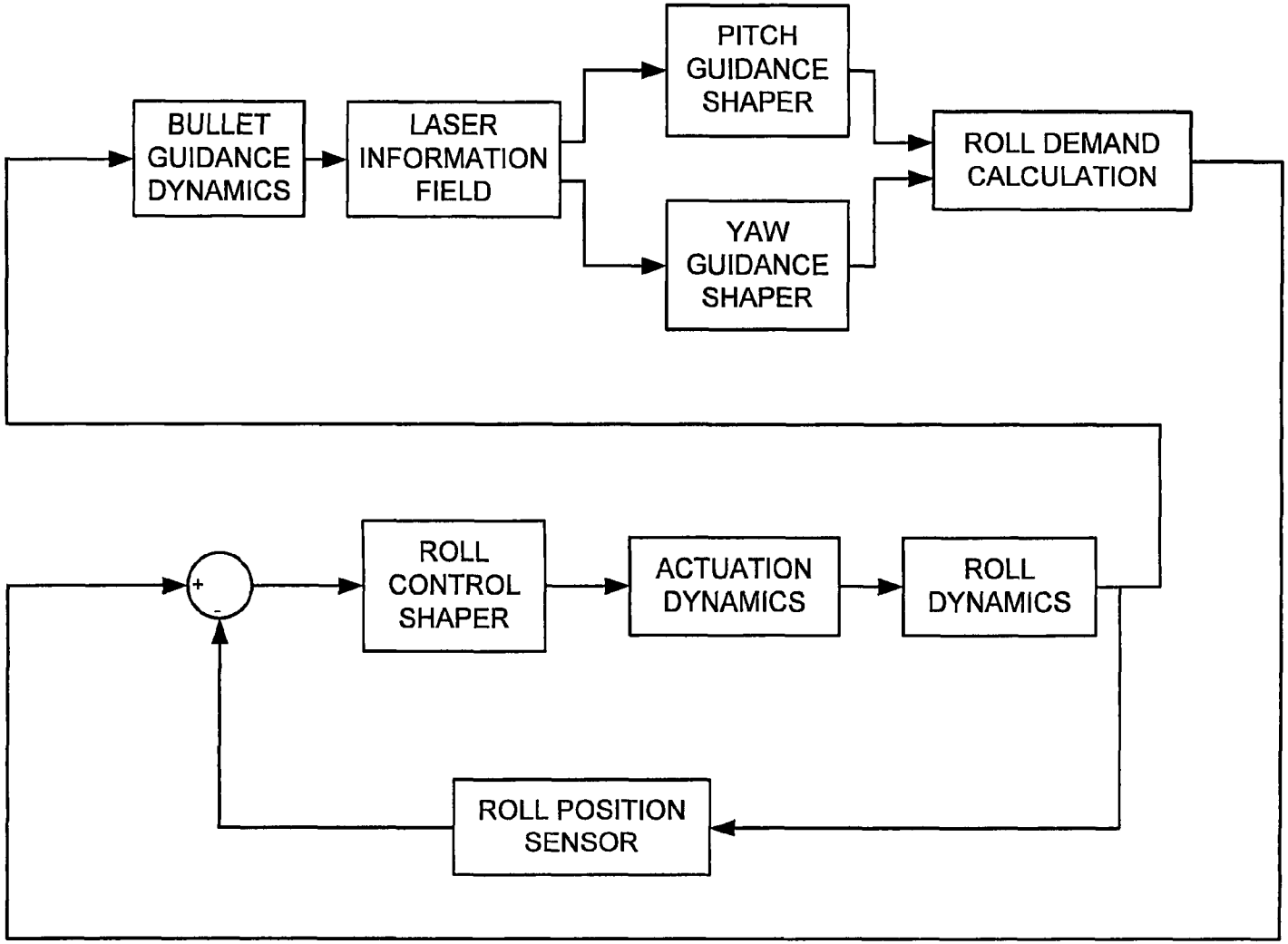
FIG. 5 is a control loop diagram for the control electronics of the bullet illustrated in FIGS. 1 to 4.

Control and function of the steerable bullet 30 will now be described with reference to FIG. 5. As shown in that figure, the control electronics and associated other electronic devices can be viewed as a control loop with two parts. A first part, illustrated at the top of FIG. 5 is a relatively conventional guidance loop such as would be used in the missile illustrated in UK patent application GB 2423502. This includes modelling of the bullet guidance dynamics, information from the laser information field and shapers for pitch guidance and yaw guidance, on the basis of which a roll demand can be calculated. This is then passed to a roll autopilot loop as illustrated in the bottom half of FIG. 5. The roll autopilot comprises a subtraction, from the demand, of the existing roll position fed back by the roll position sensor. This is then passed to a roll control shaper, and the information is then modified by models of the actuation dynamics and the roll dynamics. The resultant signal is then passed to the DC motor to modify the counter rotation of the nose with respect to the body, to alter the orientation of the nose relative to the ground.

Figure 6:
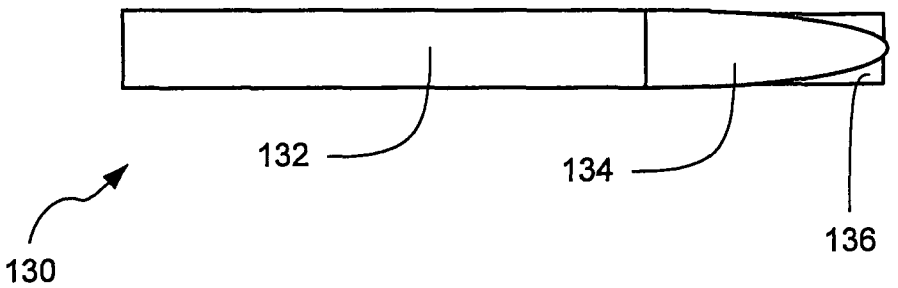
FIG. 6 is a side elevation of a guided bullet in accordance with an embodiment of the invention.
Figure 7:
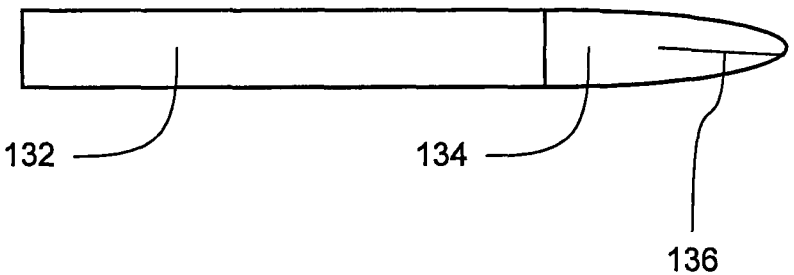
FIG. 7 is a plan elevation of the bullet illustrated in FIG. 6.

FIGS. 6 and 7 illustrate a simple variation on the above embodiment, and represent an embodiment of the invention as defined by the appended claims. In the embodiment shown therein, a bullet 130 comprises a cylindrical body portion 132 as described previously, with a hemi-ellipsoidal nose portion 134. The nose portion comprises a pair of canards 136, substantially extending radially, but not beyond, the radial extent of the body portion 132. The canards 136 are, as illustrated, substantially triangular in profile and intended to provide the desired drag component perpendicular to the axis of the bullet. To do this, the plane defined by the canards is (as illustrated) at a slight angle to the axis of the bullet. The angle to be selected will be readily appreciated by the reader to be within the knowledge of the skilled man.

Further, rather than a DC motor, a clutch may be provided in such an embodiment to act in controlling the rotation and orientation of the nose.

With regard to the above, it will be appreciated that certain limitations are imposed on operation of a bullet in accordance with either specific embodiment, by the physical forces subjected to the bullet in normal use. It is expected that accelerations during firing from a gun will be in the region of 100,000 g. This is not problematic if solid state components are used. For instance, use of a mechanical gyro may not be possible in view of the extremely high accelerations (both rotational and linear) anticipated to be imposed on the bullet. However, electronic means, such as a solid state accelerometer, provide a useful alternative to such mechanical means.

Moreover, the firing of the bullet, for instance by percussive ignition of explosive material held in the bullet casing 20, will inevitably cause substantial explosive forces to be imposed upon the diode positioned at the end of the bullet distal the nose. One option would be to include a pusher plate over the diode, which will release once the bullet has been ejected from the gun. This would protect the diode against dirt and debris the result of the explosion.

The firing of the bullet will involve such initiation steps which can be carried out in many different orders. One suggested order is that, on pulling the trigger, the battery is fired which will start rotation of the DC motor to a working speed. Around 100 ms later, the gun will actually fire the bullet by percussion of the bullet casing. This ensures that, on ejection of the bullet from the gun, the nose can already be counter-rotating at a speed substantially the same as the rotation speed of the body imparted by the rifling of the gun barrel. An initial orientation check on the nose will be useful at this point. Some form of reference point will be useful in doing this; this could be provided by providing coils at the aperture of the gun, from which the nose sensor will receive an initial reading. This will enable the control electronics to establish relatively quickly the rotation of the nose relative to the ground and to correct for this.

While asymmetric formations have been exemplified by the flat surface of the first example and the canards of the second embodiment, the reader will appreciate that other such formations are also possible, such as ribs, grooves, surface effects or even different materials used on respective sides of the nose.

Further, it will be understood by the reader that it is not essential to cause the nose portion to become stationary during flight, as any differential spin between the nose portion and the body portion may impart a steering moment on the projectile as a whole.

While the above embodiments provide suitable examples of projectiles in accordance with the invention, the reader will appreciate that alternatives are also possible. The invention is not limited to the above description, and should be read as being defined in accordance with the claims appended hereto, construed with reference to (but not bound by) the description and drawings.

The invention claimed is:

1. A steerable projectile comprising a body portion and a nose portion, the nose portion and the body portion being substantially coaxially arranged along a co-axis and rotatable relative to one another about said co-axis, the nose portion further comprising an asymmetric formation operable to enable said projectile to be subjected to off-axis drag during flight, wherein said asymmetric formation comprises one or more active surfaces, each active surface extending in a direction that is substantially radial with respect to said co-axis, the active surfaces not extending beyond the radial extent of said body portion, and each active surface being defined so as to cause the imparting of a drag component on said projectile wherein the drag component is perpendicular to the trajectory of said projectile.

2. A projectile in accordance with claim 1 wherein the body portion is substantially cylindrical and the nose portion is, but for the asymmetric formation, substantially rotationally symmetrical and coaxial with the body portion.

3. A projectile in accordance with claim 2 wherein said nose portion is substantially semi-ellipsoidal in shape, but for said asymmetric formation.

4. A projectile in accordance with claim 3 and comprising rotation means operable to cause relative rotation of said nose portion with respect to said body portion.

5. A projectile in accordance with claim 4 and comprising orientation monitoring means operable to determine orientation of said nose portion with respect to an external reference frame, and control means operable to control rotation of said nose portion with respect to said body portion.

6. A projectile in accordance with claim 2 and comprising rotation means operable to cause relative rotation of said nose portion with respect to said body portion.

7. A projectile in accordance with claim 6 and comprising orientation monitoring means operable to determine orientation of said nose portion with respect to an external reference frame, and control means operable to control rotation of said nose portion with respect to said body portion.

8. A projectile in accordance with claim 7 wherein said control means is operable to cause said rotation means to rotate said nose portion such that said nose portion is rotationally stationary with respect to said reference frame.

9. A projectile in accordance with claim 1 and comprising rotation means operable to cause relative rotation of said nose portion with respect to said body portion.

10. A projectile in accordance with claim 9 and comprising orientation monitoring means operable to determine orientation of said nose portion with respect to an external reference frame, and control means operable to control rotation of said nose portion with respect to said body portion.

11. A projectile in accordance with claim 10 wherein said control means is operable to cause said rotation means to rotate said nose portion such that said nose portion is rotationally stationary with respect to said reference frame.

12. A projectile in accordance with claim 11 wherein said control means is operable to cause said rotation means to rotate said nose portion such that said asymmetric formation causes an off-axis steering force to be imparted on said projectile.

13. A projectile in accordance with claim 11 and including communication means operable to receive a guidance signal, and wherein said control means is operable to cause said rotation means to rotate said nose portion in response to said guidance signal.

14. A projectile in accordance with claim 10 wherein said control means is operable to cause said rotation means to rotate said nose portion such that said asymmetric formation causes an off-axis steering force to be imparted on said projectile.

15. A projectile in accordance with any claim 14 and including communication means operable to receive a guidance signal, and wherein said control means is operable to cause said rotation means to rotate said nose portion in response to said guidance signal.

16. A projectile in accordance with claim 10 and including communication means operable to receive a guidance signal, and wherein said control means is operable to cause said rotation means to rotate said nose portion in response to said guidance signal.

17. A projectile in accordance with claim 1 further comprising rotation means operable to cause relative rotation of said nose portion with respect to said body portion.

18. A projectile in accordance with claim 17 and comprising orientation monitoring means operable to determine orientation of said nose portion with respect to an external reference frame, and control means operable to control rotation of said nose portion with respect to said body portion.

19. A projectile in accordance with claim 18 wherein said control means is operable to cause said rotation means to rotate said nose portion such that said nose portion is rotationally stationary with respect to said reference frame.

* * * * *